United States Patent [19]

Handler et al.

[11] Patent Number: 4,597,122

[45] Date of Patent: Jul. 1, 1986

[54] FREE-STANDING DRAWER

[75] Inventors: Milton E. Handler, Northbrook; Richard Sylvan, Glenview; Herbert Baisch, Palatine, all of Ill.

[73] Assignee: Hirsh Company, Skokie, Ill.

[21] Appl. No.: 741,750

[22] Filed: Jun. 10, 1985

[51] Int. Cl.[4] ..... A47C 21/00; A47B 88/14

[52] U.S. Cl. ..... 5/503; 5/308; 217/62; 220/345; 312/330 R

[58] Field of Search ..... 5/58, 308, 2 R, 2 B, 5/508, 503; 312/250, 330 R, 330 SM, 350; 217/62, 63, 78; 220/345, 349, 347

[56] References Cited

U.S. PATENT DOCUMENTS

| | | | |
|---|---|---|---|
| D. 263,100 | 2/1982 | Thompson | D6/4 |
| D. 270,288 | 8/1983 | Smith | D25/74 |
| D. 270,888 | 8/1983 | Whitehouse | D25/1 |
| D. 278,664 | 5/1985 | Ferdinand et al. | D6/510 |
| 936,969 | 10/1909 | Williams . | |
| 1,290,743 | 1/1919 | Herpst et al. . | |
| 1,352,002 | 9/1920 | Jones . | |
| 1,468,786 | 9/1923 | Knechtel . | |
| 1,788,905 | 1/1931 | Barnes | 217/63 |
| 2,079,330 | 5/1937 | Norinsberg et al. | 217/12 |
| 2,142,469 | 1/1939 | Williamson et al. | 220/345 |
| 2,276,374 | 3/1942 | Derman | 217/62 |
| 2,478,470 | 8/1949 | Eastman et al. | 220/345 |
| 2,551,775 | 5/1951 | Von Canon | 217/265 |
| 2,701,174 | 2/1955 | Franks | 312/263 |
| 2,801,895 | 8/1957 | Gass | 312/257 |
| 2,862,640 | 12/1958 | Somavia | 220/4 |
| 3,029,357 | 4/1962 | Williams | 312/263 |
| 3,273,952 | 9/1966 | Himelreich et al. | 312/330 |
| 3,282,635 | 11/1966 | Himelreich | 312/214 |
| 3,316,460 | 4/1967 | Scoville | 317/101 |
| 3,379,483 | 4/1968 | Oldford | 312/263 |
| 3,428,385 | 2/1985 | Scott | 312/257 R |
| 3,456,409 | 7/1969 | Piget | 52/282 |
| 3,462,208 | 8/1969 | Black et al. | 312/352 |
| 3,527,515 | 9/1970 | Grau et al. | 312/234.1 |
| 3,542,447 | 11/1970 | Himelreich | 312/330 |
| 3,554,627 | 1/1971 | Mock | 312/330 |
| 3,639,027 | 2/1972 | Higdon, Jr. | 312/330 |
| 3,687,512 | 8/1972 | Alston | 312/330 |
| 3,716,283 | 2/1973 | Little | 312/330 |
| 3,752,553 | 8/1973 | Bildahl et al. | 312/330 |
| 3,759,599 | 9/1973 | Swick | 312/262 |
| 3,759,600 | 9/1973 | MacDonald | 312/330 |
| 3,846,003 | 11/1974 | Rockwell | 312/330 |
| 3,895,733 | 7/1975 | Chambers | 312/330 |
| 4,026,616 | 5/1977 | Kuehl | 312/250 |
| 4,120,551 | 10/1978 | Godtschalk | 312/330 R |
| 4,126,213 | 11/1978 | McDonald | 190/18 A |
| 4,128,284 | 12/1978 | King | 312/330 R |
| 4,242,848 | 1/1981 | Schoultz | 49/462 |
| 4,277,122 | 7/1981 | Bargiel | 312/330 R |
| 4,279,455 | 7/1981 | Santo | 312/330 R |
| 4,450,597 | 5/1984 | Hull | 5/2 R |
| 4,466,675 | 8/1984 | Ferdinand et al. | 312/330 R |

FOREIGN PATENT DOCUMENTS

| | | | |
|---|---|---|---|
| 2755527 | 12/1977 | Fed. Rep. of Germany . | |
| 24658 | of 1909 | United Kingdom | 5/308 |

*Primary Examiner*—Alexander Grosz

*Attorney, Agent, or Firm*—Dressler, Goldsmith, Shore Sutker & Milnamow, Ltd.

[57] ABSTRACT

A free-standing drawer is provided for operational positioning under a bed or the like. The bottom wall of the drawer comprises a pair of panels and a rigidifying center support board therebetween. The drawer may be packaged and sold in knocked-down form so that the multi-panel bottom wall permits economic use of the minimum size package. Sliding doors are provided for use with molded door jambs and door tracks operationally supporting said doors.

6 Claims, 7 Drawing Figures

3
4
10
12
14
16
20
22
24
26
28
30
32
35
36
38
40
41
43
45
68
80

FREE-STANDING DRAWER

TECHNICAL FIELD

This invention relates to knock-down drawer assemblies and, more particularly, to a knock-down drawer which can be assembled into a free-standing and readily movable storage facility.

BACKGROUND OF THE INVENTION AND TECHNICAL PROBLEMS POSED BY THE PRIOR ART

A problem frequently encountered in the home is the need for adequate or additional drawer storage space. Purchase of expensive pieces of drawer furniture, such as bureaus and chests, is not always possible for economic reasons, or feasible for lack of room area or the like. The use of non-drawer storage facilities, such as foot lockers or cedar chests, may be unsatisfactory for obvious reasons of convenience and ungainly appearance.

In many instances, unutilized room area is generally available. For example, the areas under beds or high-legged drawer chests and seating furniture invariably comprise available but unused space.

It would therefore be desirable to provide a storage facility which may be positioned in heretofore wasted areas like those under beds or standing drawer chests. It would also be desirable if such a storage facility comprised a readily accesible drawer which could be easily opened and closed as frequently as desired. Moreover, such a drawer desirably should comprise an inexpensive but nonetheless attractive room addition.

SUMMARY

The present invention provides a free-standing drawer adapted to be positioned in heretofore unused areas, such as beneath a bed or high-legged chest of drawers. Postioning and use of the invention requires no special frames or mounting means.

The drawer comprises a low profile structure and includes roller means so that the drawer may be conveniently rolled out from, and back into, its storage position under a bed or the like. Slidable cover means are provided so that the contents of the drawer are protected from dirt and dust while stored.

The drawer invention may be conveniently packaged and sold in knocked down form for simple assembly by the purchaser. In this regard, the bottom wall of the drawer comprises a plurality of interconnectable panel sections so that each separate section is smaller than the full dimension of the assembled bottom wall. As a result, the knocked down drawer parts may be economically packaged in a container of minimum size. Additionally, support means is provided for operationally connecting the bottom panel sections so that the assembled bottom wall is greatly rigidified and strengthened.

The invention may be inexpensively fabricated from common mass-producible materials, such as plastics and particle board, which are durable and can be made in attractive simulated wood finishes to blend with other existing furniture.

Numerous other advantages and features of the present invention will become readily apparent from the following detailed description of the invention and the embodiments thereof, from the claims, and from the accompanying drawings.

BRIEF DESCRIPTION OF THE DRAWINGS

In the accompanying drawings forming a part of the specification, and in which like numerals are employed to designate like parts throughout the same.

DETAILED DESCRIPTION OF THE PREFERRED EMBODIMENTS

Figures 1, 2:
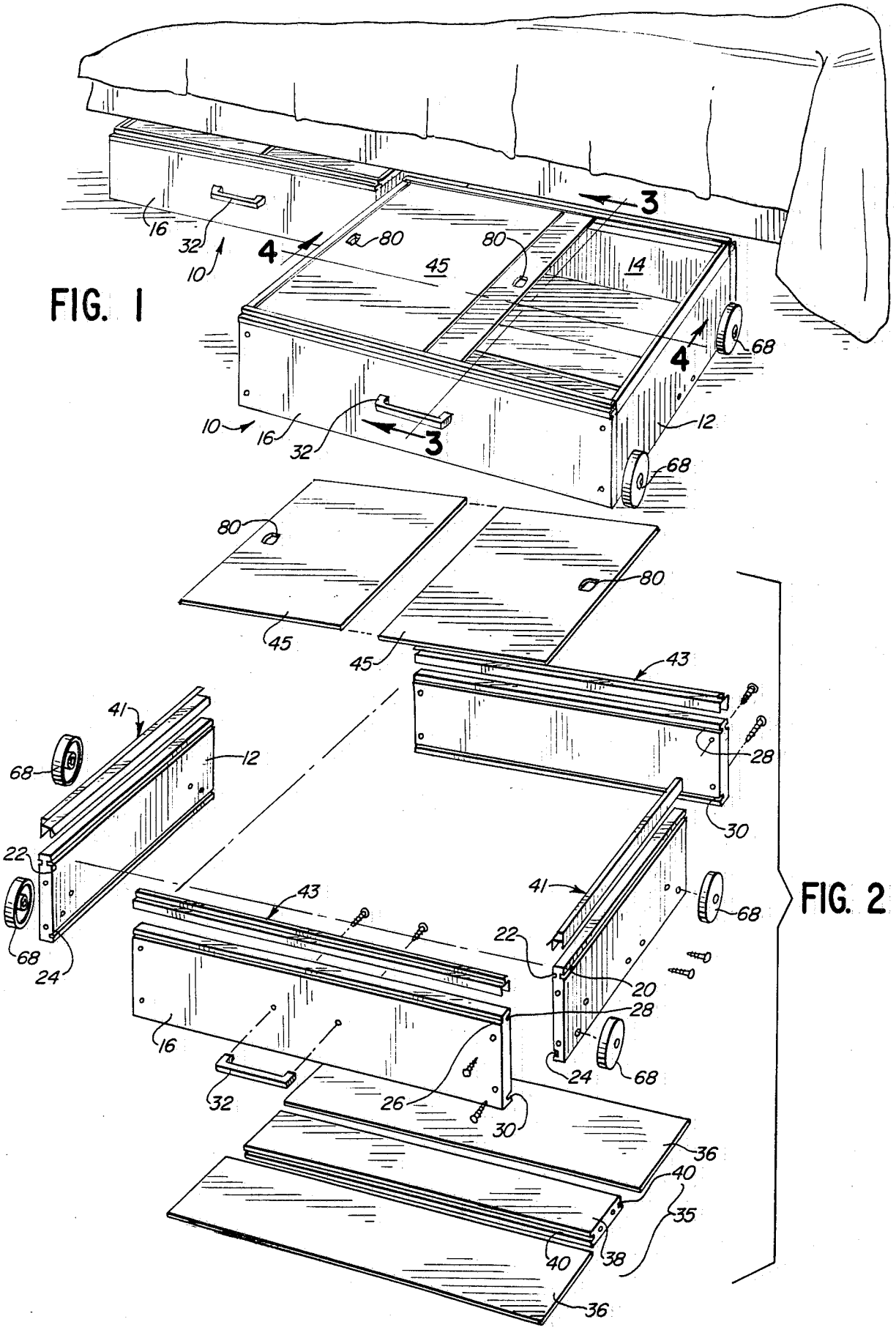
FIG. 1 is a perspective view of a pair of free-standing drawers embodying the principles of the invention shown as operationally positioned under a bed.
FIG. 2 is an exploded perspective view of the disassembled parts of the drawer.

Referring with greater particularity to the various Figures of the drawings, the reference numeral 10 indicates generally a free-standing drawer embodying the principles of the invention. Typically, the drawer 10 will be packaged and sold in knocked down form with the individual parts disassembled as illustrated in FIG. 2.

The disassembled drawer parts comprise a pair of side walls or panels 12, 12, a back wall or panel 14, and a front wall or panel 16. As illustrated in FIG. 2, each of the side wall panels 12 is formed with an outer groove 20 and an oppositely opening inner groove 22 adjacent the top edge of the panel. The grooves 20 and 22 are parallel to the panel top edge and extend over the full length of the panel between the lateral edges thereof. Adjacent to the bottom edge of each panel 12, there is provided an inner bottom groove 24 extending between the lateral edges of the panel.

The back wall panel 14 and front wall panel 16 each similarly include an outer top groove 26, an inner top groove 28, and an inner bottom groove 30.

Each of the wall panels is formed with variously positioned holes adjacent their lateral edges adapted to receive suitable connectors, such as the screws illustrated, for operationally assembling the panels into the walls of the drawer 10. The front wall panel 16 is also formed with central holes for connection thereto of a handle 32.

Figure 3:
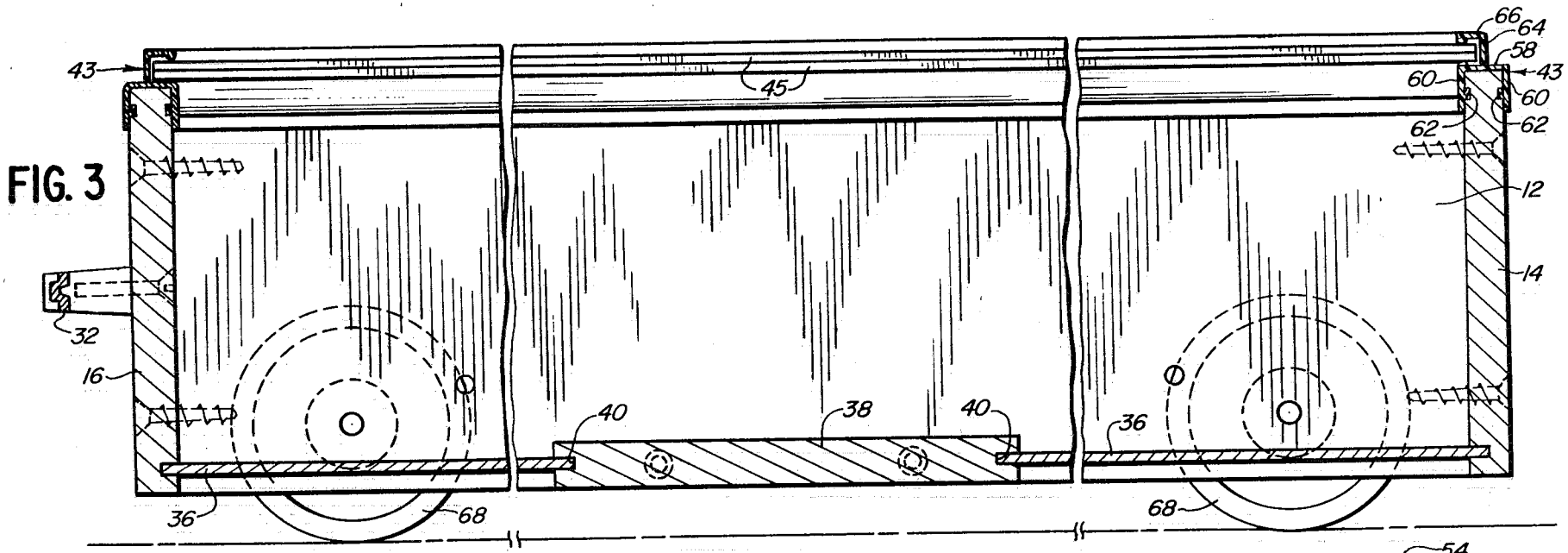
FIG. 3 is an enlarged, cross-sectional view taken along the plane 3—3 in FIG. 1.

A bottom wall 35 is provided to be supported in part by the bottom grooves 24 and 30 of the operationally assembled wall panels 12, 14, and 16. As best illustrated in FIGS. 2 and 3, the bottom wall 35 comprises a pair of bottom wall panels 36, 36, and a center support means 38. In the embodiment illustrated, the center support means 38 comprises a board of the same length as the back and front wall panels 14 and 16 and has a longitudinal groove 40 formed in each of the longitudinal edges thereof.

When operationally assembled, the center support means or board 38 is rigidly connected between the side wall panels 12 by suitable connectors, such as screws. The bottom wall panels 36 are then each supported on three sides thereof by the wall bottom grooves 24, 24, and 30, and on the fourth side, or innermost side, by the grooves 40 in the center support means 38. It will thus be appreciated that the bottom wall 35 is rigidified and strengthened by the slightly thicker center support 38 to prevent or reduce sagging or bowing of the bottom wall under the weight of contents carried thereon.

A door jamb 41 is mounted on each of the side wall panels 12, and a door track 43 is mounted on the back wall panel 14 and front wall panel 16. The jambs and tracks are adapted to operationally guide and retain sliding door panels 45, 45.

Figure 5:
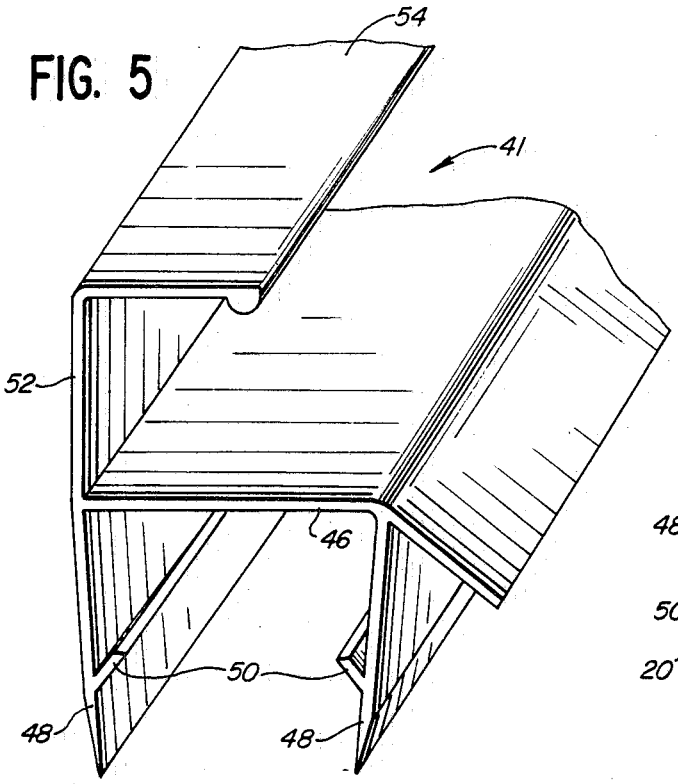
FIG. 5 is a greatly enlarged, fragmentary, perspective view of a door jamb of the invention.
Figure 6:
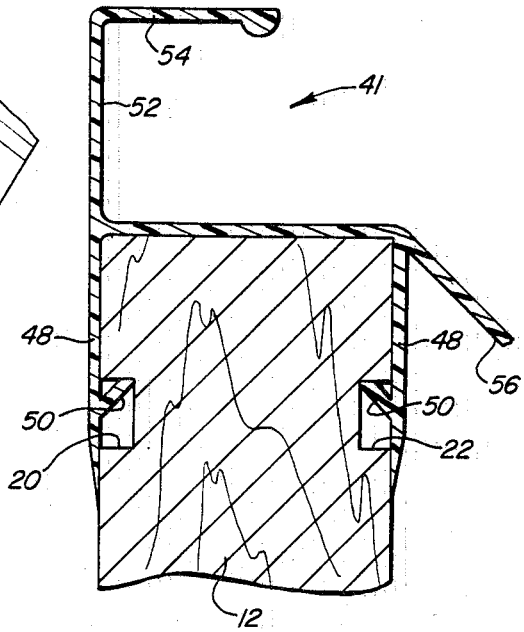
FIG. 6 is a cross-sectional view showing the door jamb operationally mounted on a side panel of the drawer.

Referring particularly to FIGS. 5 and 6, it will be seen that the door jamb 41 comprises an elongated channel-shaped member having a web 46, and depending legs 48, 48. Integrally formed on the inner face of each of the legs 48 is an upwardly projecting finger 50. A stop wall 52 and a closure wall 54 project upwardly and inwardly, respectively, from the web 46 for cooperating therewith to provide a jamb for receiving the lateral edges of the sliding door panels 45 in a manner which will become apparent as the description proceeds. An angled guide lip 56 extends inwardly from the web 46 for insuring smooth entry of each sliding door panel 45 into the jamb 41.

Figure 4:
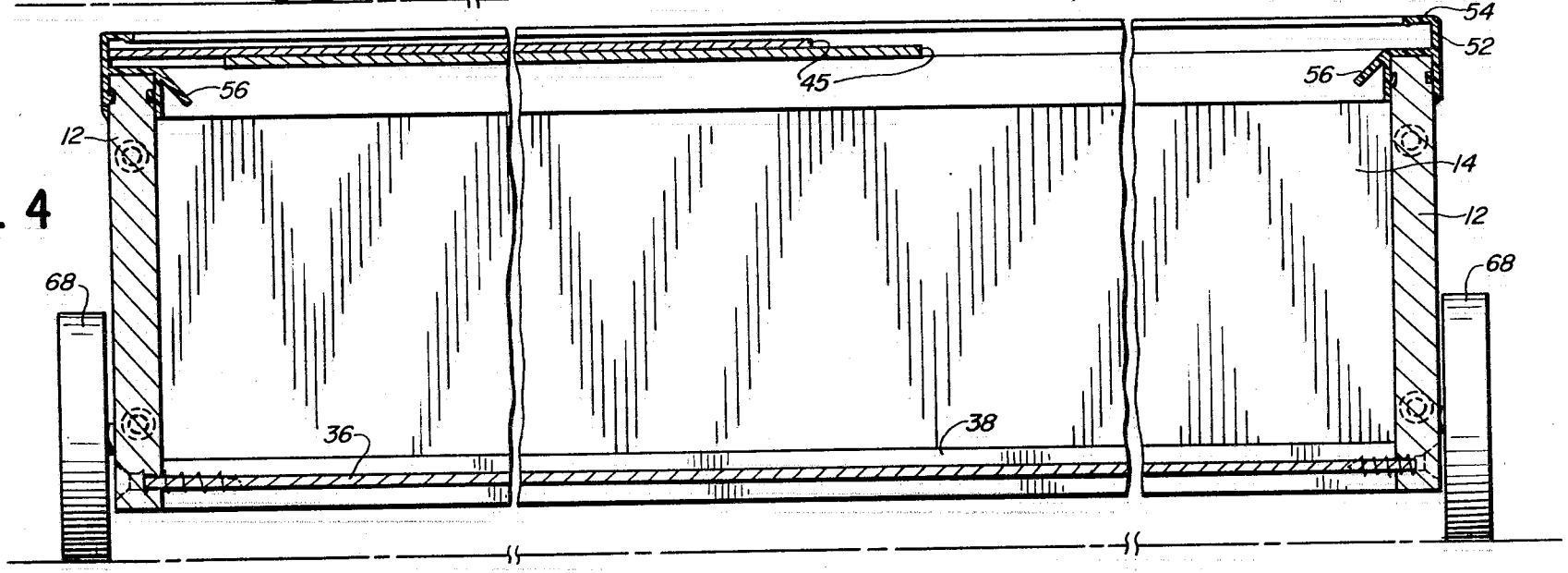
FIG. 4 is an enlarged, cross-sectional view taken along the plane 4—4 in FIG. 1.

The entire door jamb 41 may be integrally molded from a resilient plastic and is shaped so that the depending channel legs 48 are normally angled or biased slightly toward each other (see FIG. 5). To operationally mount the door jamb 41 on a side wall panel 12, it is simply necessary to spread the channel legs 48 and press the jamb 41 over the top of the side wall panel 12 until the fingers 50 snap into the outer and inner top grooves 20 and 22 (see FIGS. 4 and 6).

Door tracks 43 are of similar integrally molded construction. As best illustrated in FIG. 3, each track 43 comprises a channel-shaped member having a web 58 and depending legs 60, 60, with angled fingers 62 for snap-fitting the same over the top edge of an associated back wall or front wall panel 14 or 16 (see FIG. 3). A vertical wall 64 and cover wall 66 project upwardly and inwardly, respectively, from the web 58 and cooperate therewith to provide a track for the door panels 45.

The door panels 45 are dimensioned to partially overlap at the center of the drawer 10 when the drawer is closed, and suitable recessed pulls 80, knobs, or other appropriate means may be provided for operating the door panels 45.

Roller means, such as wheels 68, are provided for supporting the drawer 10 and permitting easy movement thereof during use. In the preferred embodiment illustrated, the wheels 68 are rotatably mounted from the side wall panels 12 by suitable conventional bolts and bushings (not shown). Wheel mounting holes are provided in the side wall panels 12, and pairs of such holes may be provided at varying vertical spacing from the bottom edges of the panels 12 to accommodate drawer use on a variety of supporting surfaces, such as hardwood or deep pile carpeting.

The construction, operation, and advantages of the drawer 10 should now be apparent to those skilled in the art. It will be noted that inexpensive materials of construction, such as relatively thin pressed board panels, may be employed for the drawer bottom wall and doors without excessive bowing or sagging of such materials which might otherwide occur. For example, the center support 38 and multiple bottom wall panels 36 cooperate to provide a sturdy bottom wall and likewise permit knocked down packaging in a shipping container of cost effective minimum size. The free-standing form with wheeled support enables easy access to the drawer interior and return to the stored position under a bed or the like.

Figure 7:
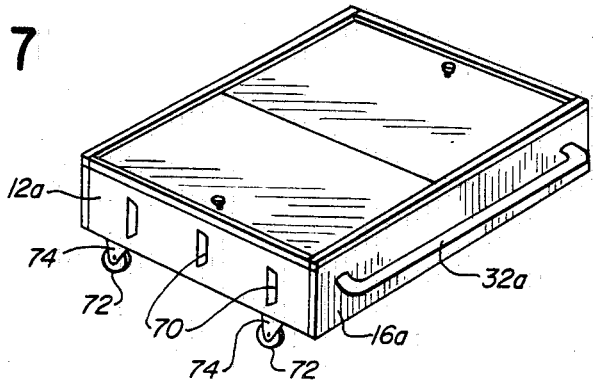
FIG. 7 is a perspective view of a modified embodiment of the free-standing drawer of the invention.

It should likewise be apparent that the invention admits to a variety of styling changes and simulated wood finishes to match a desired room and furniture decor. A modified style of the invention is illustrated in FIG. 7 wherein similar parts are identified by similar reference numerals with the suffix "a." It will there be seen that the drawer **10*a* includes side walls 12*a*, 12*a* which have ventilator means or louvers 70 provided therein. Attached to the front wall 16*a* is an elongated handlebar 32*a* which extends substantially over the entire length of said front wall. Wheels 72 are mounted from the bottom wall by means of depending brackets 74. Roller casters, or the like, could also be substituted for the wheels 72. Operation of drawer 10*a* is the same as that of the preferred embodiment of the drawer 10 discussed above with reference to FIGS. 1–6**.

It will be readily observed from the foregoing detailed description of the invention and the illustrative embodiments thereof that numerous variations and modifications may be effected without departing from the true spirit and scope of the novel concept of the principles of the invention.

What is claimed is:

1. A free-standing drawer adapted for operational positioning under a bed or the like comprising:

a pair of side walls, a back wall, and a front wall;

a multi-panel bottom wall supported between said side, back, and front walls;

support means interconnecting said bottom wall panels;

door means mounted on said side, back, and front walls closing the top of said drawer and movable to provide access to the interior thereof, said door means including a pair of sliding door panels and further including jamb means and track means mounted on said drawer walls for operationally guiding said door panels therein, said track means including a pair of elongated integral track members each having a pair of legs defining a channel, said track legs being normally angled toward each other, the track legs of one of said track members being snap-fittingly mounted on the top of said back wall and the track legs of the other of said track members being snap-fittingly mounted on the top of said front wall; and roller means supporting said drawer whereby said drawer may be readily rolled out from, and back under, said bed or the like.

2. A free-standing drawer adapted for operational positioning under a bed or the like comprising:

a pair of side walls, a back wall, and a front wall;

a multi-panel bottom wall supported between said side, back, and front walls;

support means interconnecting said bottom wall panels;

door means mounted on said side, back, and front walls closing the top of said drawer and movable to provide access to the interior thereof, said door means including a pair of sliding door panels and further including jamb means and track means mounted on said drawer walls for operationally guiding said door panels therein, said jamb means including a pair of elongated integral jamb members each having a pair of jamb legs defining a channel, each jamb member having a door guide lip projecting from a base of one of said jamb legs, said jamb legs being normally angled toward each other, the jamb legs of each of said jamb members being snap-fittingly mounted on the top of one of said drawer side walls; and roller means supporting said drawer whereby said drawer may be readily rolled out from, and back under, said bed or the like.

3. A free-standing drawer adapted to be operationally positioned under a bed or the like comprising:

a pair of vertical side walls, a vertical back wall, and a vertical front wall, said walls being connected together in generally right angle relationship;

each of said walls defining inner and outer top grooves adjacent the wall top and defining an inner bottom groove adjacent the wall bottom;

a center support board fixedly connected between said side walls and defining a longitudinal groove in each longitudinal edge of said board;

a pair of bottom wall panels operationally retained in said wall inner bottom grooves and in said center support board longitudinal grooves to provide the bottom of said drawer;

a pair of sliding door panels closing said drawer and slidable to provide access to the interior thereof; and jamb and track means mounted on said drawer walls for operationally guiding said door panels, said jamb and track means including an opposed pair of elongated integral jamb members and an opposed pair of elongated integral track members, respectively, each member having a pair of legs defining a channel with the legs, said jamb members being snap-fittingly mounted over the tops of said side walls whereby said legs cooperate with the associated inner and outer top grooves, and said track members being snap-fittingly mounted over the tops of said back and front walls whereby said legs cooperate with the associated inner and outer top grooves.

4. A drawer according to claim 3 wherein each said jamb member includes a projecting lip portion for guiding the marginal portions of one of said door panels into said jamb member.

5. A drawer according to claim 3 wherein each member leg includes a projecting finger for being received in one of said grooves.

6. A drawer according to claim 3 further including wheels mounted from the lower corners of said drawer whereby said drawer may be readily rolled out from and back under said bed or the like.

* * * * *